United States Patent [19]

Wemekamp

[11] 3,943,814

[45] Mar. 16, 1976

[54] ELECTRIC ORGAN TONE GENERATING SYSTEM

[76] Inventor: Henry Wemekamp, 201 Van Horne Ave., Apt. 1009, Willowdale, Ontario, Canada

[22] Filed: Aug. 26, 1974

[21] Appl. No.: 500,297

[52] U.S. Cl. ..... 84/1.01; 84/1.11; 84/1.19

[51] Int. Cl.[2] ..... G10H 1/00

[58] Field of Search ..... 331/1 R, 1 A, 2, 10, 11, 331/16, 18, 19, 44, 111; 84/1.01, 1.04, 1.11, 1.19, 454; 324/78 D, 79 R, 79 D

[56] References Cited

UNITED STATES PATENTS 3,610,800 10/1971 Deutsch ..... 84/1.01

3,806,826 4/1974 Schlosser ..... 331/1 A

*Primary Examiner*—L. T. Hix
*Assistant Examiner*—U. Weldon

[57] ABSTRACT

An electric organ tone generating system in which each organ tone is generated by an individual independent oscillator with built-in computer means for individually tuning each individual oscillator in turn from a fixed crystal controlled reference oscillator. All the individual oscillators are of identical construction except for the tuning components of the oscillator.

8 Claims, 6 Drawing Figures

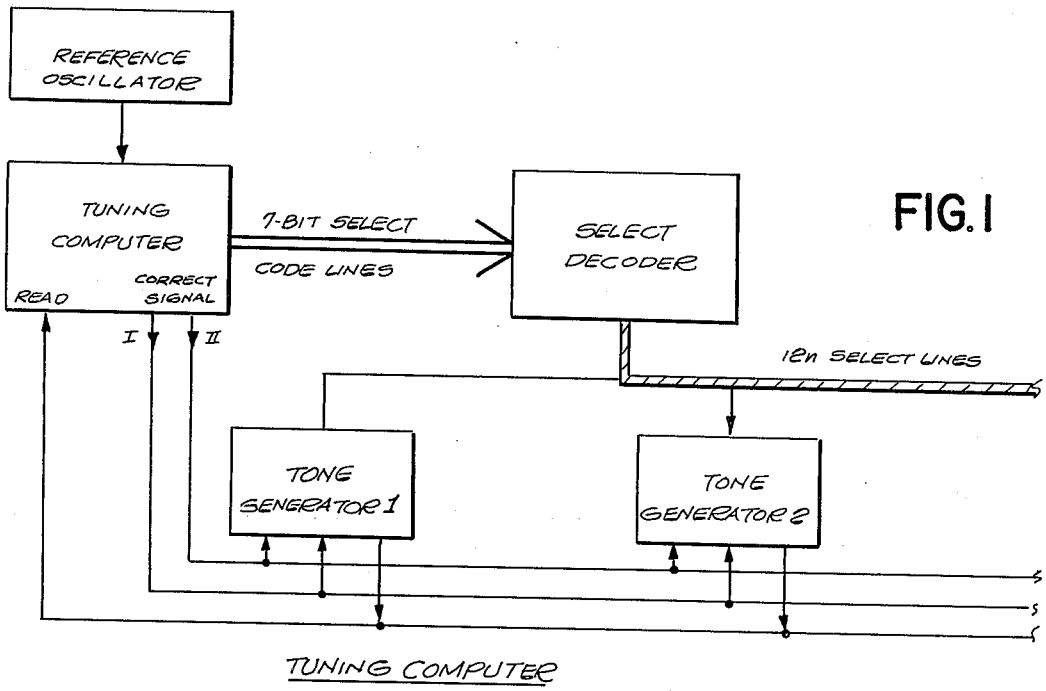
FIG. 1
FIG. 2
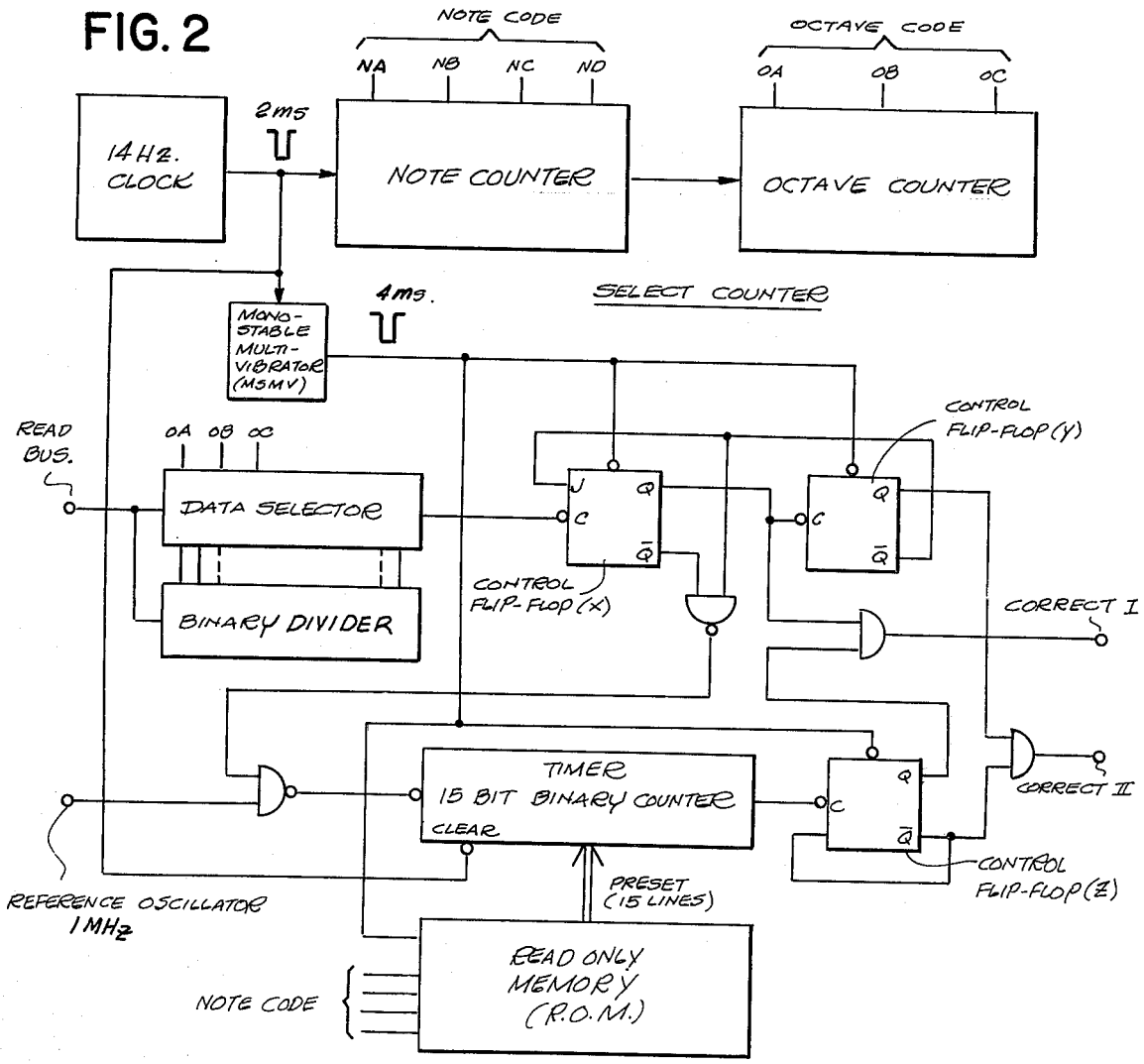

FIG. 3A
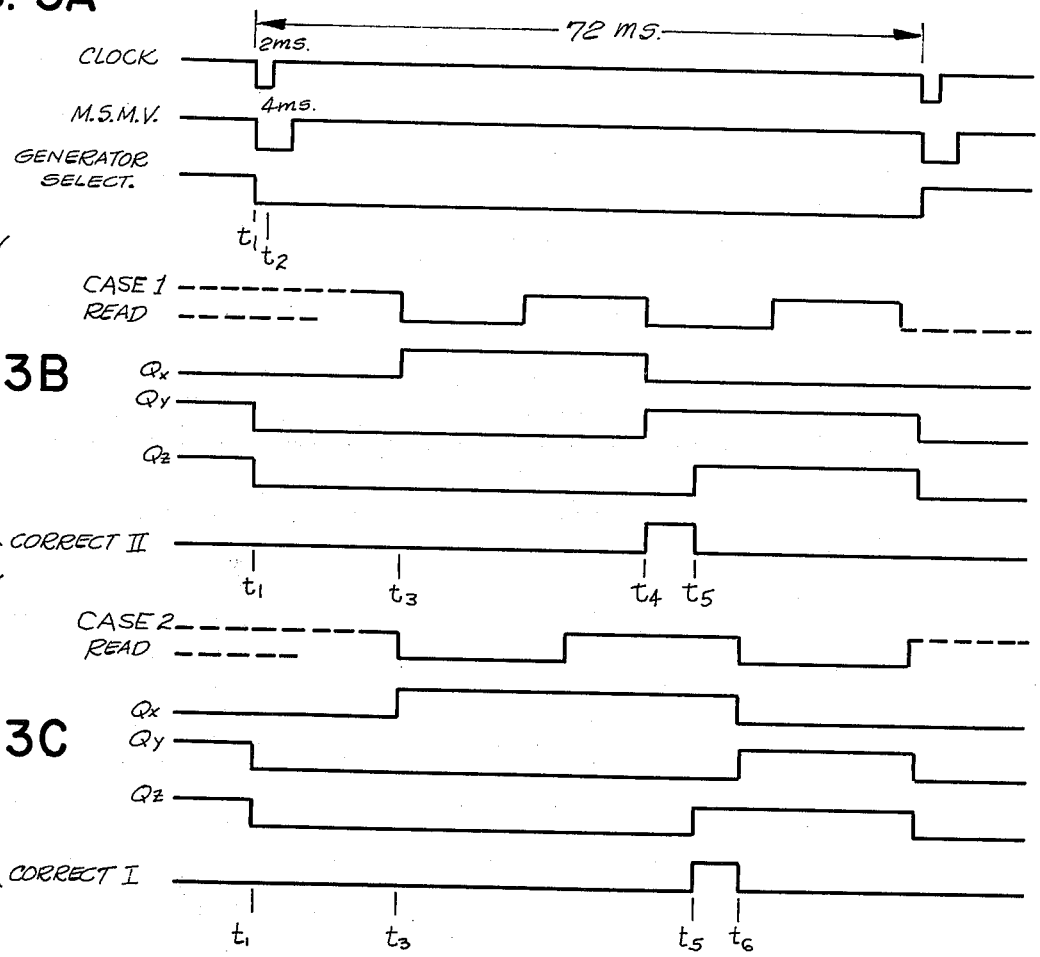
FIG. 3B
FIG. 3C
FIG. 4
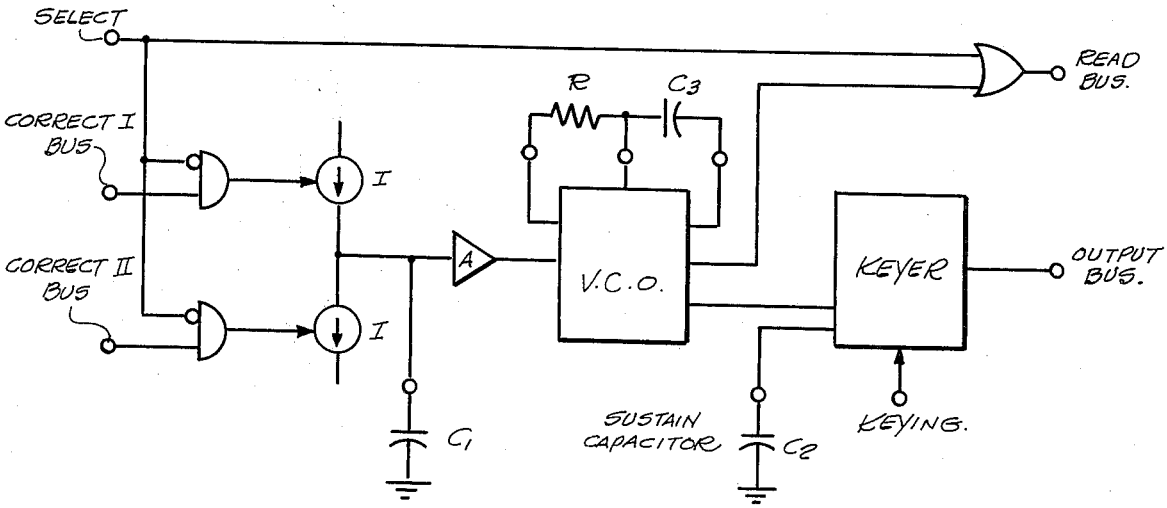

ELECTRIC ORGAN TONE GENERATING SYSTEM

SUMMARY OF THE INVENTION

My invention relates to the tone generating system of an electric organ in which each organ tone is generated by an individual oscillator, with each oscillator being of identical construction save for the frequency determining components.

The individual oscillators of the circuit are tuned by a master computer in the circuit which sets each oscillator, in turn, after comparing the output of the oscillator with a master reference crystal controlled oscillator.

Tone generating systems for electronic organs fall into two main categories; individual oscillator, and divider systems. The latter is most often found in lower priced organs, since only twelve oscillators are required to generate the top octave. Lower octaves are generated by binary division, which may be done at very low cost with digital IC's.

The individual oscillator system unquestionably provides better tonal quality; and has traditionally been used in larger, better quality organs. However, this approach is considerably more costly, since a highly stable oscillator, using expensive components, is required for each tone in the organ with as many as 97 in a single rank organ and several hundred in multi-rank designs. This system, by its very nature, does not lend itself to the use of integrated circuits.

With the use of low cost MSI and LSI integrated circuits, the invention produces an organ utilizing low cost, low stability oscillators. Automatically maintaining the tuning, by the circuitry devised results in the accuracy of the more expensive present systems. The invention consists of a tuning computer; with a high stability reference oscillator, and a set of tone generators. The computer selects each individual tone generator in turn, compares its frequency to a representation of the correct frequency held in the memory, and provides a correct pulse to bring the specific tone generator back into tune.

BRIEF DESCRIPTION OF THE DRAWING

The objects and features of the invention may be understood with reference to the following detailed description of an illustrative embodiment of the invention, taken together with the accompanying drawings in which:

FIG. 1 is a schematic diagram of the Tone Generating System;

FIG. 2 is a schematic diagram of the Tuning Computer;

FIG. 3A is a chart of the Timing Sequence of the Tuning Computer;

FIG. 3B is a chart of a second Timing Sequence of the Tuning Computer;

FIG. 3C is a chart of a third Timing Sequence of the Tuning Computer; and

FIG. 4 is a schematic diagram of the Tone Generator Keyer circuit.

DESCRIPTION OF THE PREFERRED EMBODIMENT

Turning now descriptively to the drawings, in which similar reference characters denote similar elements throughout the several views, FIG. 1 illustrates the tone generating system in which a Tuning Computer selects sequentially the tone output signal of an individual Tone Generator 1, 2 with twelve tone generators making up each octave of the organ. The signal of the selected Tone Generator is read by the Tuning Computer and compared with a reference signal from a crystal controlled oscillator. The computer then sends out a correction signal to the connected Tone Generator, to tune the Tone Generator.

As shown in FIGS. 2, 3A, 3B and 3C, the tuning Computer functions from the pulses of a 14Hz clock which provides a pulse to increment the SELECT counter which comprises a 4 bit note counter to select sequentially one of the twelve tone generators of an octave C, C sharp, D, D sharp, E, F, F sharp, G, G sharp, A, A sharp and B, and a 3 bit octave counter to select the desired octave 1, 2 . . . 8, thus a rank of 96 tone generators of 8 octaves will be retuned every 7 seconds.

The operating sequence of the Tuning Computer is as follows with $t_1 \ldots t_5$ representing time intervals shown in FIGS. 3A, 3B and 3C:

$t_1$:
- a. SELECT Counter is advanced one note,
- b. Control Flip-Flops X, Y, and Z are reset by the Monostable-Multivibrator (MSWV) which was triggered by the clock pulse,
- c. Reference Oscillator input is inhibited
- d. Timer is reset.

$t_2$:
- a. Timer is preset to a count; selected by the note code; from the ROM (Read Only Memory).

$t_3$:
- a. The tone generator selected by the 7 bit select code applies its signal to the READ Bus. This signal is divided down; to appear in the first octave; by the programable divider consisting of a binary divider chain and a data selector. The falling edge of READ flips control flip-flop X.
- b. The reference oscillator gate is enabled and timer begins to count down toward zero.

Case I — Tone Generator Frequency Too High $t_4$:
- a. READ goes 'low' again
- b. $Q_x$ goes low
- c. $Q_y$ goes high, $\overline{Q}_y$ goes low and locks X
- d. Correct II goes high to decrease Tone Generator Frequency $t_5$:
- a. Timer reaches zero
- b. Control Flip-flop Z flips, i.e. $Q_z$ goes high
- c. Correct II returns low.

Case II — Tone Generator Frequency Too Low $t_5$:
- a. Timer reaches zero
- b. $Q_z$ goes high
- c. Correct I goes high to increase Tone Generator Frequency $t_6$:
- a. READ goes low again
- b. $Q_x$ goes low
- c. $Q_y$ goes high
- d. $\overline{Q}_y$ goes low and locks X
- e. Correct I goes low again FIG. 4 illustrates the circuitry of the Tone Generator/Keyer.

An individual tone generator is selected by a low input on its select line. This enables the correct gates, and allows the oscillator signal to appear on the READ bus. A pulse on either Correct Bus will switch on its related current source, and the voltage on capacitor $C_1$ will change by an amount proportional to the width of the Correct pulse, which was proportional to the tuning error; thus, tuning error will tend toward zero during successive tuning cycles. Tuning will be dependent only on the reference oscillator, and will not be affected by changes in generator component values due to environment or aging. One or more electronic keyer circuits may be included in the tone generator integrated circuit.

The system of the Preferred Embodiment may be modified at the discretion of the organ designer. The reference oscillator frequency may be varied during the 7 second tuning cycle to 'stretch' the chromatic scale with lower octaves tuned flat, and higher octaves tuned sharp, to provide a controlled amount of 'chorus' effect. Read and Correct lines may be time-multiplexed to allow a single Tuning Computer and Select Decoder to be used with several ranks of Tone Generators. Vibrato might possibly be added, if a Vibrato Kill circuit is included in the tone generator IC to disable the vibrato input during the 72 ms tuning interval.

The system is designed to be compatable with present LSI technology. The entire tuning computer, including memory and reference oscillator may be built into one LSI chip. All oscillators in the organ are identical, except for tuning components. Therefore, a tone generator chip could be designed and mass produced at low cost.

Since obvious changes may be made in the specific embodiment of the invention described herein, such modifications being within the spirit and scope of the invention claimed, it is indicated that all matter contained herein is intended as illustrative and not as limiting in scope.

Having thus described the invention, what I claim as new and desire to secure by Letters Patent of the United States is:

1. Apparatus for generating a multiplicity of tones as required in an electronic organ comprising a. a plurality of free running tone oscillators for producing each of said required tones, each of said tone oscillators including means for controlling the frequency thereof in response to a stored control voltage, means for altering said control voltage in response to a CORRECT pulse present on a CORRECT bus, a gate coupling said CORRECT bus to said control voltage altering means, a select input coupled to said gate for enabling said gate to pass pulses from said CORRECT bus to said control voltage altering means, a second gate coupled to said select input for enabling pulses from said tone oscillator to appear on a READ bus, b. means for sequentially selecting each of said tone oscillators, including a source of auxilliary clock pulses, a binary counter, means coupling said clock pulses to said counter to increment said counter, means for decoding the content of said counter into a plurality of select lines, means coupling each of said select line to one of said tone oscillators via its select input, c. logic means coupled to said selection means and to said CORRECT and READ bus including a frequency comparator, means coupling said comparator to said READ bus, storage means for storing a representation of each desired tone oscillator frequency, means coupled to said storage means for selecting said representation corresponding to said selected tone oscillator, means coupled to said frequency comparator for generating said CORRECT pulse in response to the difference between the frequency of said selected tone oscillator and said representation selected from said storage means, means coupling said CORRECT pulse generating means to said CORRECT bus.

2. Apparatus as claimed in claim 1 wherein said CORRECT pulse has a characteristic which is proportional to the magnitude of the difference in frequencies.

3. Apparatus as claimed in claim 1 wherein each of said tone oscillators includes keyer means for coupling the signal of said tone oscillator to an OUTPUT bus in response to a keying signal.

4. Apparatus as claimed in claim 1 wherein said binary counter comprises a note counter generating a note select code, and an octave counter generating an octave select code.

5. Apparatus as claimed in claim 4 including a programable divider circuit for dividing the signal from said selected tone oscillator appearing on said READ bus, in response to said octave select code.

6. Apparatus according to claim 4 wherein said storage means comprises a Read Only Memory containing representations of the desired frequencies of each of the twelve notes of an octave, and wherein said means, coupled to said storage means for selecting said representation corresponding to said selected tone oscillator, is responsive to said note select code.

7. Apparatus according to claim 4 wherein said frequency comparator includes a master reference oscillator and wherein said representation of said desired frequency is indicative of a number of cycles of said master reference oscillator.

8. Apparatus according to claim 7 including means coupled to said master reference oscillator for varying the frequency thereof.

* * * * *